United States Patent [19]

Cheng

[11] Patent Number: 4,800,632

[45] Date of Patent: Jan. 31, 1989

[54] APPARATUS FOR PRODUCING LEAVES FOR CHRISTMAS TREE

[76] Inventor: Chun-Nang Cheng, No. 72-7, Chao An Li, Pai Her Chen, Tainan Hsien, Taiwan

[21] Appl. No.: 143,509

[22] Filed: Jan. 13, 1988

[51] Int. Cl.[4] ..... B23P 23/00

[52] U.S. Cl. ..... 29/33 R; 29/417; 428/7

[58] Field of Search ..... 29/33 F, 33 R, 417, 29/564, 561, 563; 140/149, 118; 156/61; 57/24, 12; 364/468; 428/7, 18

[56] References Cited

U.S. PATENT DOCUMENTS

| | | | |
|---|---|---|---|
| 3,665,577 | 5/1972 | Dieffenbach | 29/564 |
| 3,834,976 | 9/1974 | Mottel | 428/7 X |
| 4,171,850 | 10/1979 | Eriksson | 29/33 F |
| 4,573,247 | 3/1986 | Spinelli | 29/417 |
| 4,590,105 | 5/1986 | Shaffer | 156/61 X |
| 4,609,989 | 9/1986 | Squarei | 364/468 |

FOREIGN PATENT DOCUMENTS

| | | | |
|---|---|---|---|
| 157066 | 10/1985 | European Pat. Off. | 428/7 |

*Primary Examiner*—William Briggs
*Attorney, Agent, or Firm*—Browdy & Neimark

[57] ABSTRACT

An apparatus for producing leaves for Christmas tree has a housing securing thereon an iron wire source, a plastic cloth source, a cutting means for continuously cutting two sides of the cloth, a shearing means for regularly shearing in desired shape the cloth, a guiding means clamping two iron wires from the iron wire source against two surfaces of the cloth substantially at the longitudinal axis of the cloth a twisting means clamping together the two iron wires and the cloth and capable of twisting and tidily tangling them together, and a breaking means breaking the tangled iron wires and cloth so as to produce a leaf for a Christmas tree, and to automate the production of such leaf.

3 Claims, 7 Drawing Sheets

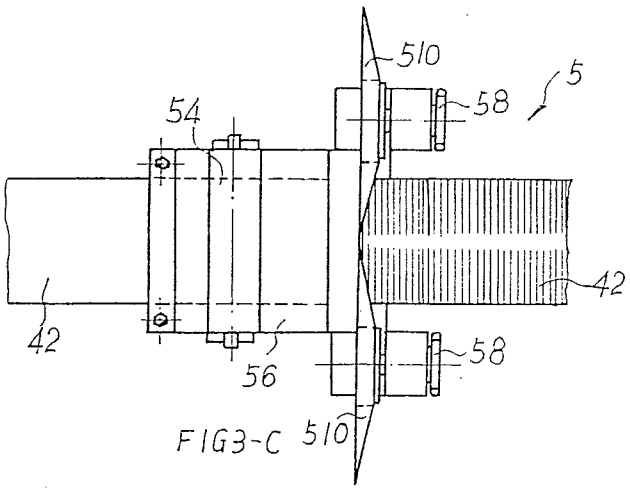
FIG 3-C
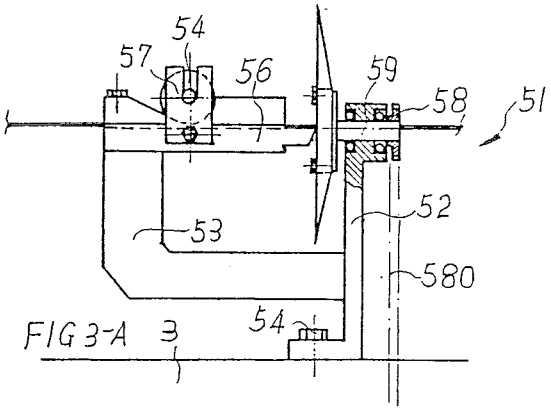
FIG 3-A
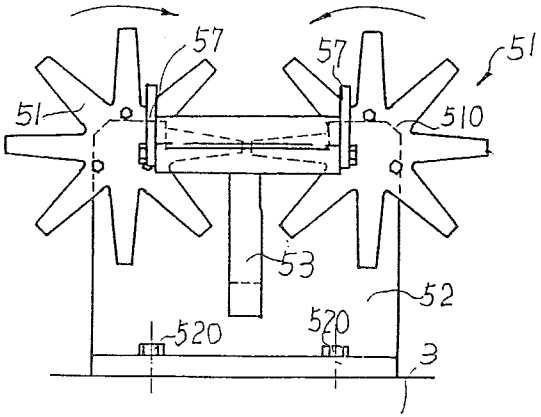
FIG 3-B

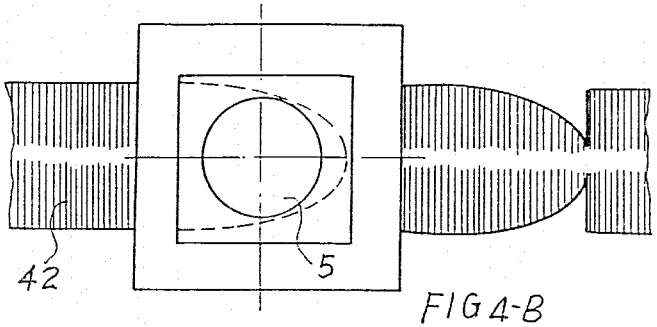
FIG 4-B
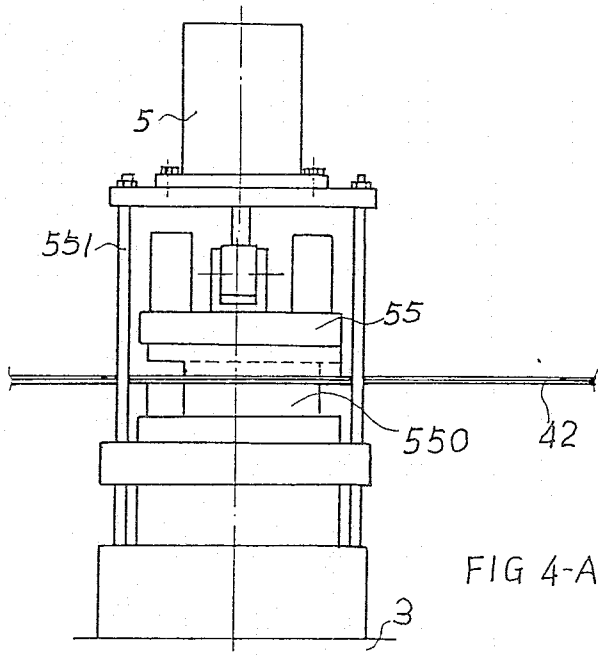
FIG 4-A

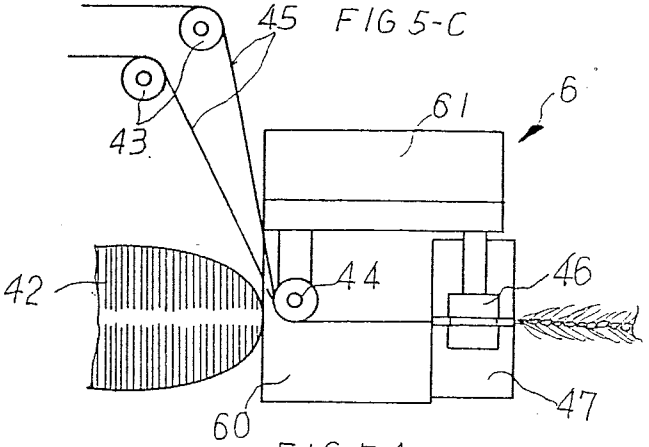
FIG 5-C
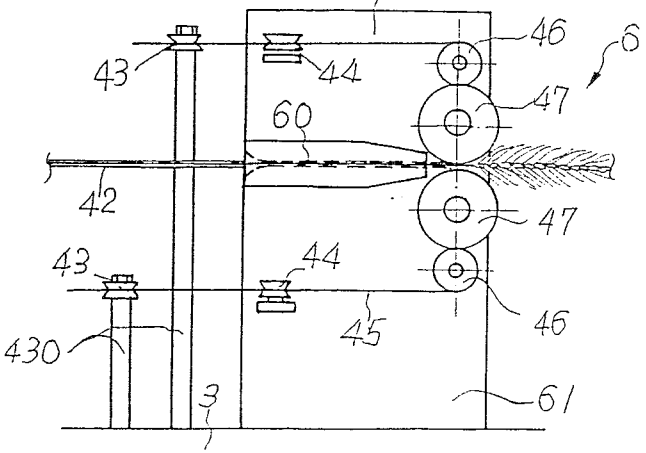
FIG 5-A
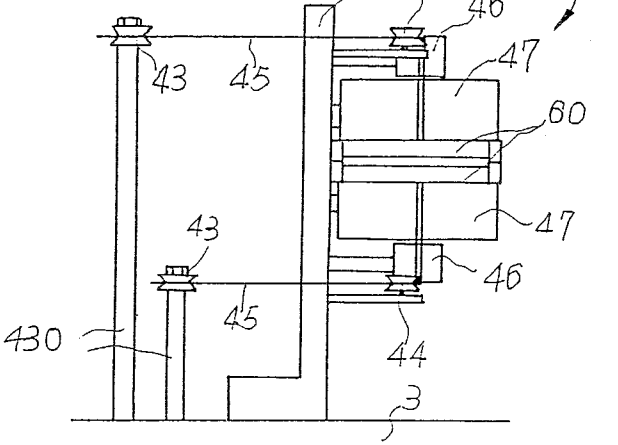
FIG 5-B

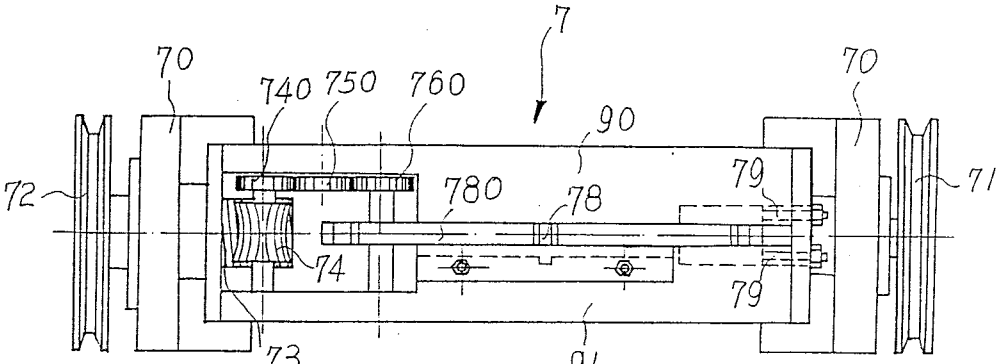
FIG 6-C
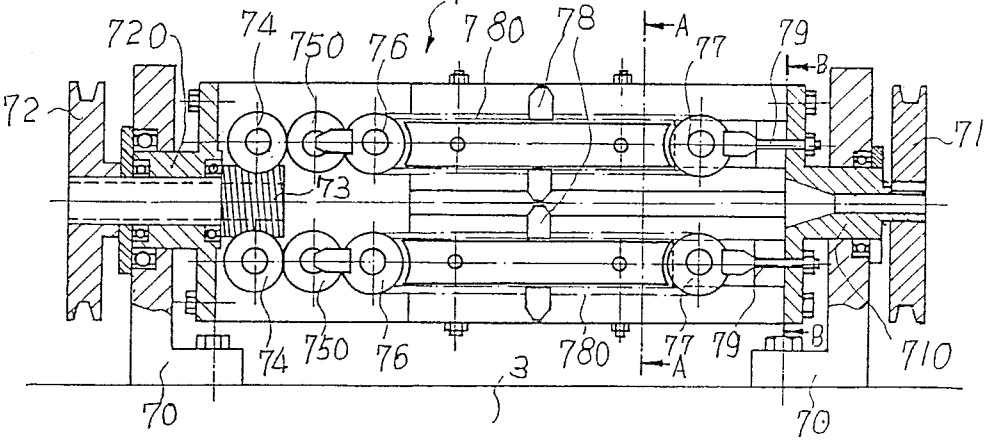
FIG 6-A
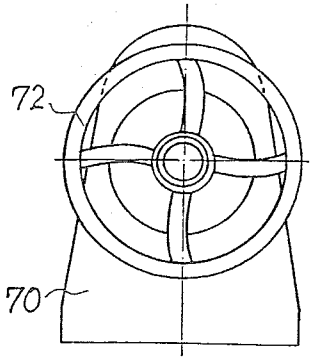
FIG 6-B

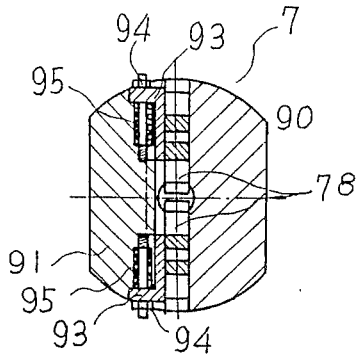
FIG 6-D
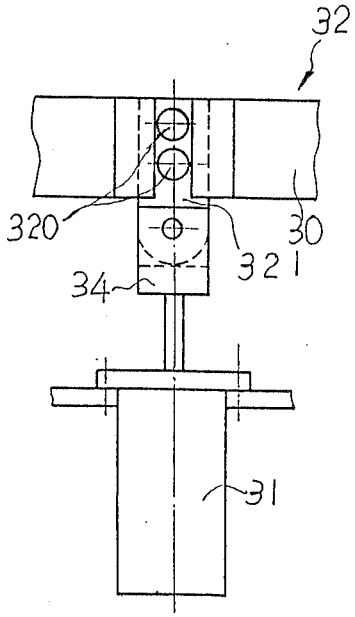
FIG 7-B
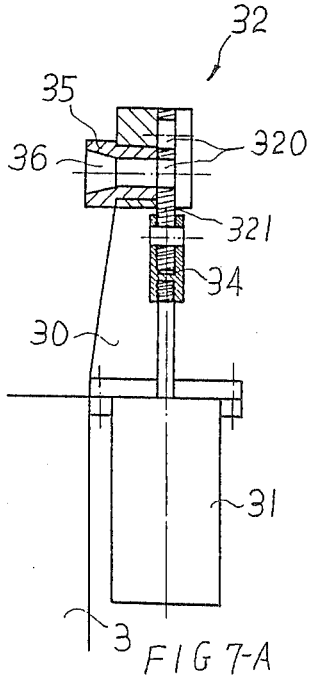
FIG 7-A

APPARATUS FOR PRODUCING LEAVES FOR CHRISTMAS TREE

BACKGROUND OF THE INVENTION

The present invention relates to a producing apparatus, and more particularly to an aparatus for producing leaves for Christmas tree.

Known methods for manufacturing leaves for Christmas tree includes the iron wire twisting method and the plastic moulding method. The latter is not extensively used since it is expensive and difficult in manufacturing the leaves and the leaves produced thereby have a poor strength. The former is thefore relatiavely widely used and however, suffers from the following disadvantages:

1. The iron wires and the plastic cloth are not positively twisted together and easily get loose; and 2. It calls for a large magnitude of manpower in cutting the two sides of the plastic cloth into desired small strips and therefore the production volume is greatly limited.

It is therefore attempted by the applicant to overcome the disadvantages encountered by the prior art.

SUMMARY OF THE INVENTION

It is therefore an object of the present invention to provide an automatic apparatus for producing leaves for Christmas tree.

It is another object of the present invention to provide leaves for Christmas tree of which the iron wires and the plastic cloth are positively tangled together and will not get loose easily.

According to the present invention, an apparatus for producing leaves for Christmas tree has a housing securing thereon an iron wire source, a plastic cloth source, a cutting means for cutting two sides of the cloth, a shearing means for regularly shearing in desired shape the cloth, a guiding means clamping two iron wires form the iron wire source against two surfaces of the cloth substantially at the longitudinal axis of the cloth, a twisting means clamping together the two iron wires and the cloth and capable of twisting and tidily tangling them together, and a breaking means breaking the tangled iron wires and cloth so as to produce a leaf for a Christmas tree and to automate the production of such leaf.

The present invention may best be understood through the following description with reference to the accompanying drawings, in which:

BRIEF DESCRIPTION OF THE DRAWING

FIGS. 3A–3C are respectively side, front and top views showing a cutting means of an apparatus for producing leaves for Christmas tree according to the present invention;

FIG. 4A and 4B are side and top views showing a shearing means of an apparatus for producing leaves for Christmas tree according to the present invention;

FIGS. 5A–5C are respectively side, front and top views showing a guiding means of an apparatus for producing leaves for Christmas tree according to the present invention;

FIGS. 6A–6D are side, front, top and sectional views showing a twisting means of an apparatus for producing leaves for Christmas tree according to the present invention, and FIGS. 7A and 7B are side and rear views showing a breaking means of an apparatus for producing leaves for Christmas tree according to the present invention.

DETAILED DESCRIPTION OF THE PREFERRED EMBODIMENT

Figure 1:
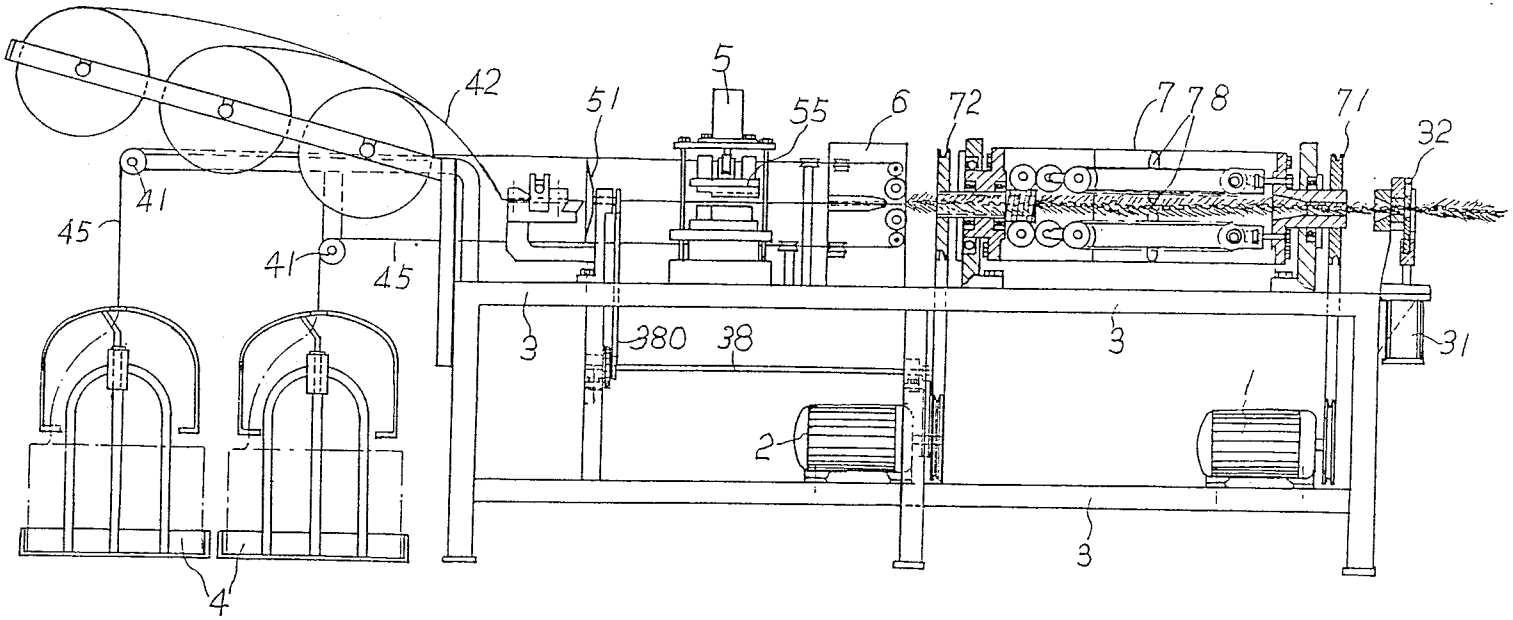
FIG. 1 is a side view showing a preferred embodiment of an apparatus for producing leaves for producing leaves for Christmas tree according to the present invention.
Figure 2:
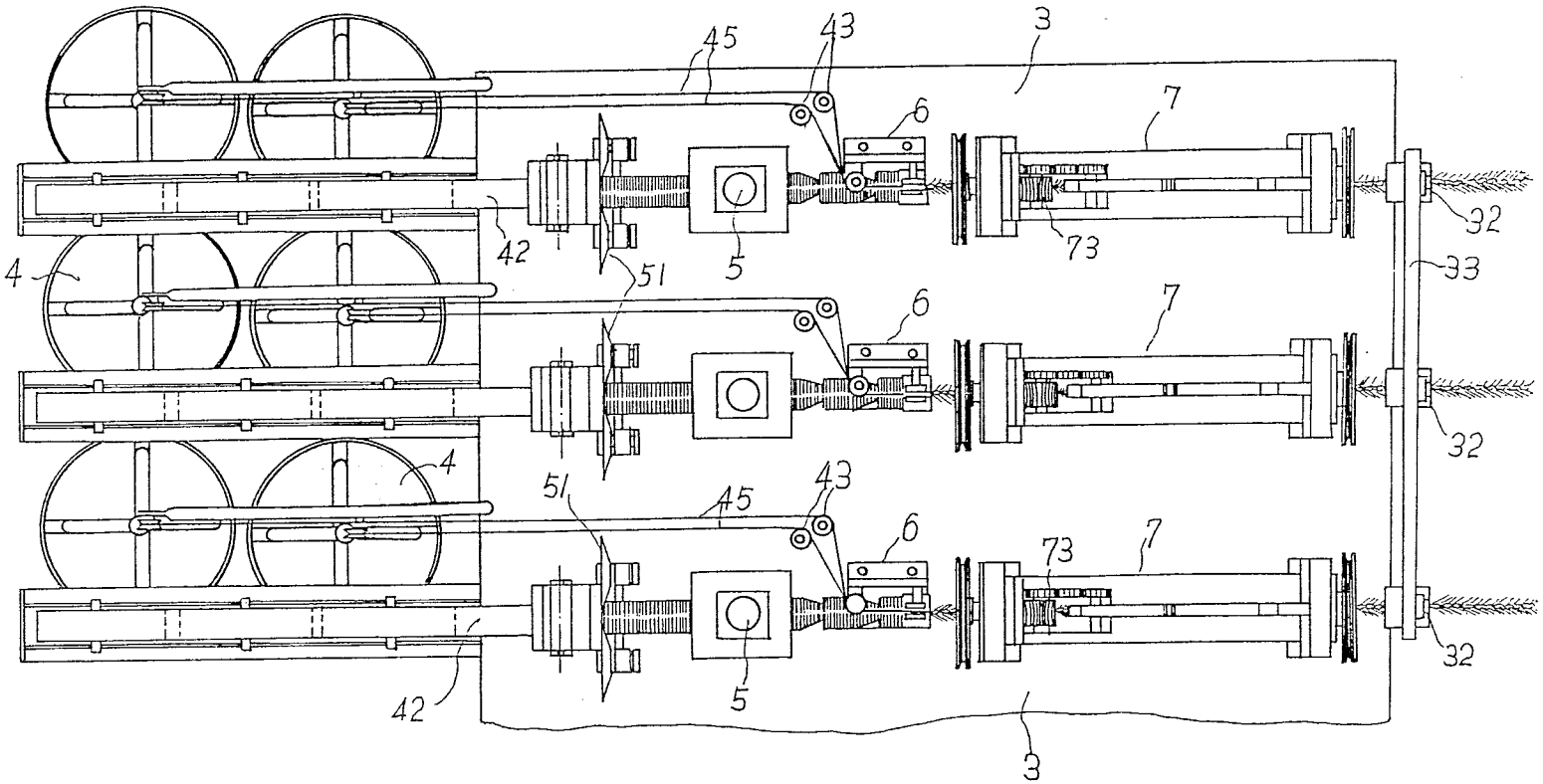
FIG. 2 is a top view showing an apparatus for producing leaves for Christmas tree according the present invention.

Referring now to FIGS. 1 and 2, there is shown an apparatus for producing leaves for Christmas tree according to the present invention which includes a housing 3 securing thereon in sequence a cutting means 51, a shearing means 55, a guiding means 6, a twisting means 7 and a breaking means 32. Twisting means 7 is driven to rotate by a motor 1 and clamping media 78 therein are driven to run by another motor 2 fixed on housing 3 which drives cutting means 51 also via a connecting rod 33. Iron wire sources 4 fixed on housing 3 feed iron wires 45 which are guided into guiding means 6 through two pairs of guiding wheels 41, 43 respectively. A plastic cloth 42 constituted by 3 overlapping cloth sheets originating from 3 cloth sheet sources fixed on housing 3 is sent, after cut by cutting means 51, shorn by shearing means 55 and passing through guiding means 6, to twisting means 7 which not only pulls in iron wires 45 and plastic cloth 42 but also twists and tidily tangles them together. Finally, the tangled iron wires 45 and plastic cloth 42 is regularly broken by breaking means 32.

As shown in FIGS. 3A–3C, a cutting mean 51 for an apparatus for producing Christmas tree's leaves according to the present invention includes an angled plate 52 fixed on housing 3 by bolts 520, an L-shaped arm 53 secured on plate 52 and securing thereon a guiding medium 56, two mounting frames 57 symmetrically provided on two sides of guiding medium 56, a roller 54 rotatably mounted on mounting frames for passing plastic cloth 42 between roller 54 and guiding medium 56, two rotating shafts 59 fixed on two side of the top of plate 52, two blade plates 510 secured on the front ends of shafts 59, and two sprockets 58 secured on the rear ends of shafts 59. Two chains 580 respectively mount on sprockets 58 and another two sprockets 380 (FIG. 1) secured on one end of connecting rod 33 in order that blade plates 510 are driven by motor 2 to rotate in opposite directions. The two juxtaposed blade plates 510 pass therebetween plastic cloth 42 and each includes a plurality of blades such that when driven to rotate, they will continuously cut respectively two side of plastic cloth 42.

As shown in FIGS. 4A and 4B, and shearing means 55 for an apparatus for producing leaves for Christmas tree according to the present invention includes a bottom mould half 550 fixed on housing 3, a top mould half 552 and an air cylinder 5 which connects top mould half 552 with its piston rod and is supported above shearing means 55 by a plurality of supporting rods 551. Since plastic cloth 42 passes between mould halves 552, 550 and cylinder 5 has a timed operation, plastic cloth 42 coming from cutting means 51 will be regularly shorn in desired shape.

As shown in FIGS. 5A–5C, a guiding means 6 for an apparatus for producing leaves for Christmas tree according to the present invention includes a plate guiding frame 61 fixed on housing 3, a guiding plate 60 mounted on frame 61 and having a central slit for passing therethrough plastic cloth 42 coming from shearing means 55, a pair of vertically spaced clamping wheels 47 disposed at the outlet of cloth 42 on plate 60 for passing therebetween cloth 42, a first pair of vertically spaced guiding wheels 46 respectively engaging therebetween clamping wheels 47, a second pair of guiding wheels 44 respectively guiding two iron wires 45 such that wires 45 respectively run along the surfaces of guiding wheels 46 and clamping wheels 47 and are clamped by wheels 47 respectively to clamp therebetween cloth 42 coming from guiding plate 60 substantially at the longitudinal axis of cloth 42, two fixing rods 430 of different height fixed on housing 3 in front of frame 61, and a third pair of guiding wheels 43 which are respectively mounted on fixing rods 430 and guide wires 45 between second pair of guiding wheels 44 and a fourth pair of guiding wheels 41 near iron wire sources 4.

As shown in FIGS. 6A–6D, a twisting means 7 for an apparatus for producing leaves for Christmas tree according to the present invention includes two fixing pieces 90, 91 defining therebetween a longitudinal gap, two horizontally spaced shafted caps 710, 720 attaching thereto fixing pieces 90, 91 by bolts, two securing frames 70 secured on housing 3 and rotatably securing thereon caps 710, 720, a belt wheel 71 fixed to shafted cap 710 and driven by motor 1 via a belt to set twisting means 7 in rotation, two vertically spaced pairs of horizontally spaced sprockets 76, 77, disposed in the longitudinal gap defined by fixing pieces 90, 91 two chains 780 respectively mounted on two pairs of sprockets 76, 77 and regularly securing thereon a plurality of clamping media 78, two securing block securing thereon the shafts of sprockets 77 and fixed to cap 710 by adjustable bolts 79 in a manner that the distance between sprockets 76, 77 can be adjusted by means of adjustable bolts 79, two second pair of gears 760 respectively mounted on the shafts of sprockets 76, a third pair of idle gears 750 mounted on fixing piece 90 and meshing with gears 760 respectively, a first pair of gears 740 respectively meshing with gears 750, a pair of worm gears 74 mounted on the shafts of gears 740, hollow worm 73 rotatably mounted on cap 720 and meshing worm gears 74, and a belt wheel 72 secured on worm 73 and driven by motor 2 via a belt so that when driven belt wheel 72 will drive chains 780 to rotate in opposite directions through the transmission of worm 73, worm gears 74, gears 740, gears 750, gears 760 and sprockets 76. Thus, wires 45 and cloth 42 passing through worm 73 will be spacedly clamped by clamping media 78. When twisting means 7 is driven to rotate by motor 1, cloth 42 and wires 45 on two opposite surfaces of cloth 42 will be twisted and tidily tangled together since they are clamped by clamping media 78 and also by clamping wheels 47. Since motor 2 simultaneously drives belt wheel 72 to rotate chains 780 in opposite directions, clamping media 78 will clamp and carry wires 45 and cloth 42 to run therewith and to leave twisting means 7 from the central hole in cap 710 toward breaking means 32. As shown in FIG. 6D, the shaft mountings 93 for sprockets 76, or 77 can be two L-shaped pieces symmetrically and vertically spacedly fixed on fixing piece 91 by two adjustable bolts 94 each of which positions a compression spring 95 between L-shaped mountings 93 and fixing piece 91 in a manner that the distance between two vertically spaced shaft mountings 93 can be adjusted by adjusting the depth bolts 94 thread into fixing piece 91 and thus the clamping gap between two vertically symmetrical clamping media 78 can be adjusted in order to clamp therebetween cloth 42 and iron wires 45 of various diameter.

As shown in FIGS. 7A and 7B, a breaking means 32 for an apparatus for producing leaves for Christmas tree according to the present invention includes a guiding piece 35 fixed on a mounting 30 secured on housing 3 and having a central hole 36 for passing therethrough tangled iron wires 45 and cloth 42 coming from the central hole in cap 710, and a breaking piece 321 which is slidably disposed on mounting 30 against the outlet of tangled iron wires 45 and cloth 42 on guiding piece 35, has two vertically spaced holes 320 capable of passing therethrough the tangled iron wires 45 and cloth 42 and is connected to an air cylinder 31 through a connecting medium 34 so that each time when piece 35, 321 are set in vertical relative movement by cylinder 31, i.e. when either hole 320 becomes non-communicating with hole 36 from an aligning position with hole 36, they will break tangled iron wires 45 and cloth 42 to so produce a leaf for Christmas tree. With the vertically reciprocating movement of air cylinder 31 synchronized with the shearing action of shearing means 45, the transportation of tangled iron wires 45 and cloth 42 from twisting means 7 will not be obstructed.

As shown clearly in FIG. 2, housing 3 can be constructed thereon a plurality of apparatus for producing leaves for Christmas tree according to the present invention. Thus, the mass production and the automation of leaves production are achieved.

What I claim is:

1. An apparatus for producing leaves for Christmas tree comprising a housing adapted to be connected to an iron wire source and a plastic cloth source and fixing thereon in sequence the following means:

a cutting means including two juxtaposed rotating blade plates for continously cutting respectively two sides of said plastic cloth passing therebetween;

a shearing means including two vertically spaced mould halves adapted to be driven by an air cylinder for regularly shearing in desired shape said plastic cloth coming from said cutting means;

a guiding means including a guiding plate having a central slit for passing therethrough said plastic cloth coming from said shearing means, a pair of vertically spaced clamping wheels disposed at the outlet of said cloth on said guiding plate for passing therebetween said cloth, a first pair of vertically spaced guiding wheels engaging therebetween said clamping wheels respectively, and a second pair of guiding wheels respectively guiding two iron wires from said iron wire source such that said two iron wires respectively run along the surface of said first pair of guiding wheels and said clamping wheels and are clamped by said clamping wheels respectively to clamp therebetween said cloth coming from said guiding plate substantially at the longitudinal axis of said cloth;

a twisting means having a plurality of running clamping media for clamping therebetween said two iron wires and said cloth coming from said guiding means, and being rotatable along said longitudinal axis so as to twist said two iron wires and said cloth and tidily tangle them together; and a breaking means including a guiding piece having a central hole for passing therethrough said tangled iron wires and cloth coming from said twisting means, and a breaking piece disposed against the outlet of said tangled iron wires and cloth on said guiding piece, having two vertically spaced holes capable of passing therethrough said tangled iron wires and cloth and adapted to be driven by an air cylinder such that each time when said pieces are set in vertical relative, movement, they will break said tangled iron wires and cloth to so produce a leaf for a Christmas tree.

2. An apparatus for producing leaves for Christmas tree as claimed in claim 1 wherein each blade plate of said cutting means includes a plurality of blades.

3. An apparatus for producing leaves for Christmas tree as claimed in claim 2 wherein said twisting means further includes:

two vertically spaced pairs of horizontally spaced sprockets, each pair mounting thereon a chain regularly securing thereon said clamping media;

a worm rotatably mounted on said housing;

two vertically spaced worm gears meshing therebetween said worm;

a first pair of gears resepctively mounted on the shafts of said worm gears; and a second pair of gears respectively mounted on the shafts two sprockets containing one sprocket from each said pair of sprockets and meshing respectively with said first pair of gears such that when said worm is driven, said clamping media on said two chains of said two pairs of sprockets will run in the same direction.

* * * * *